US007232970B1

(12) United States Patent
Chen

(10) Patent No.: US 7,232,970 B1
(45) Date of Patent: Jun. 19, 2007

(54) SAFETY START SWITCH FOR A PNEUMATIC TOOL

(76) Inventor: Li-Hsueh Chen, No.74, Ching-Wu East Rd., Taichung (TW) 401

( * ) Notice: Subject to any disclaimer, the term of this patent is extended or adjusted under 35 U.S.C. 154(b) by 0 days.

(21) Appl. No.: 11/143,136

(22) Filed: Jun. 3, 2005

(51) Int. Cl.
*H01H 9/20* (2006.01)

(52) U.S. Cl. ..... 200/332.2; 200/43.17; 200/322; 200/334

(58) Field of Classification Search ..... 200/43.01, 200/43.16–43.19, 43.21, 522, 61.85, 344, 200/61.86, 321, 322, 332.2
See application file for complete search history.

(56) References Cited

U.S. PATENT DOCUMENTS 3,881,081 A * 4/1975 Schilling et al. ..... 200/522
4,381,037 A * 4/1983 Cuneo ..... 200/321
5,698,122 A * 12/1997 Lubieniecki et al. .... 200/43.17
6,025,574 A * 2/2000 Colangelo, Jr. ..... 200/43.17
6,695,072 B2 * 2/2004 Izumisawa ..... 173/168
6,700,091 B2 * 3/2004 Jones et al. ..... 200/43.17
6,854,631 B2 * 2/2005 Burke et al. ..... 227/130

* cited by examiner

*Primary Examiner*—Michael A. Friedhofer

(57) ABSTRACT

A safety start switch for a pneumatic tool including a main body, a compression strip, a push knob, a coupling element, a spring, and a pivot pin. After a corresponding arrangement of the above-mentioned components, the compression strip is not compressible in the ordinary state since the coupling element rests on the blocking portion of the main body. Meanwhile, the compression strip is downwardly swiveled to move the piston in the same direction responsive to the removal of the coupling element from the blocking position of the coupling element when the push knob is shifted against the resilience of the spring.

1 Claim, 3 Drawing Sheets

SAFETY START SWITCH FOR A PNEUMATIC TOOL

BACKGROUND OF THE INVENTION

1. Fields of the Invention

The invention relates to an actuating switch for a pneumatic tool, and more particularly, to a compact switch can be easily assembled and operated.

2. Description of the Related Art

Most of actuating switches for conventional pneumatic tools is simply constructed as a very simple "start knob". Consequently, it's required to compress the knob for use of the pneumatic tool. In spite of the simple configuration, a hidden risk exists when this kind of the pneumatic tool is used. In other words, an unintentional compression of the start knob could result in a serious consequence.

In order to improve the aforementioned drawbacks, a safety switch is attached to the stark knob. In brief, the safety switch has to be actuated before the start knob is compressed. In this way, an expected protection can be ensured.

Presently, there are a lot of patented safety switches at the market. However, the pneumatic tools with a safety switch all have the same drawbacks: complicated components, difficult assembly, high defect rate, costly production, etc.

SUMMARY OF THE INVENTION

A primary object of the invention is to eliminate the above-mentioned drawbacks and to provide an actuating switch for a pneumatic tool in which a push knob is displaceable to control the position of a compression strip. Meanwhile, a piston rises above a main body. In this way, it's not required to fit any component of the safety start switch within the hollow chamber of the main body, thereby simplifying the assembly steps and lowering the requirement of the assembly precision. Accordingly, the production cost and the defect rate can be tremendously reduced.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 2:
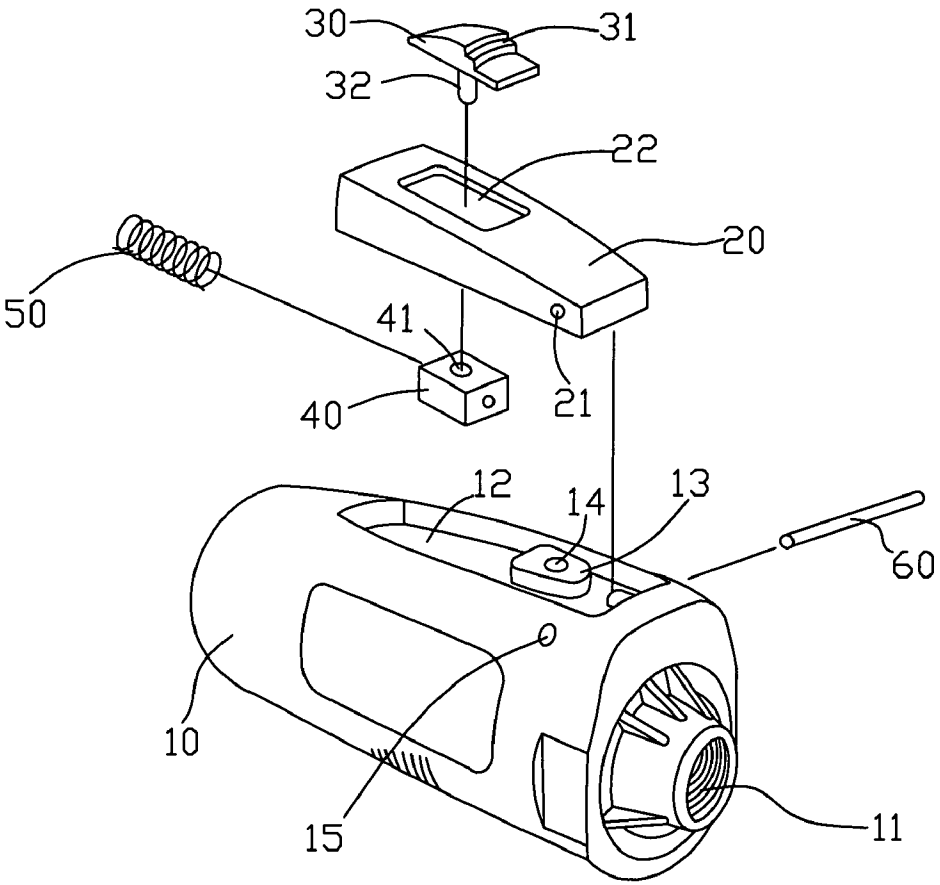
FIG. 2 is an exploded view of the preferred embodiment of the invention in accordance with FIG. 1.
Figure 1:
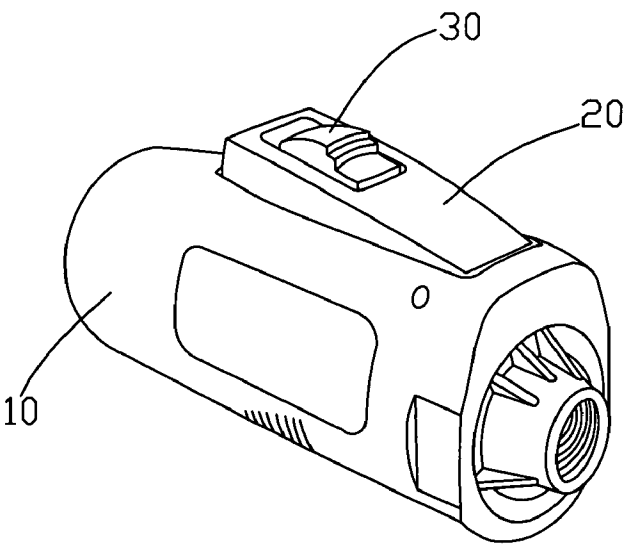
FIG. 1 is a perspective view of a preferred embodiment of the invention.

Referring to FIGS. 1 and 2, a preferred embodiment of the invention includes a main body 10, a compression strip 20, a push knob 30, a coupling element 40, a spring 50, and a pivot pin 60.

The main body 10 contains a hollow chamber 11. A recess 12 is formed in the top of the main body 10. Meanwhile, a blocking portion 13 is disposed within the recess 12 while a piston 14 rises above the center of the blocking portion 13. Besides, a pin hole 15 is formed at the top of each side of the main body 10.

The compression strip 20 includes a pin hole 21 at one end thereof and an opening 22 at a top side thereof. Meanwhile, the compression strip 20 is pivotally disposed in the recess 12 of the main body 10.

The push knob 30 includes a stepped portion 31 at top thereof and a protruding pin 32 at bottom thereof.

The coupling element 40 includes a receiving hole 41 into which the protruding pin 32 of the push knob 30 fits in a tight manner for a firm connection. The coupling element 40 and the push knob 30 are clamped between the top and bottom sides of the compression strip 20 through the opening 22 of the compression strip 20.

The spring 50 is interposed between the coupling element 40 and the compression strip 20.

The pivot pin 60 fits into the aligned pin holes 15, 21 of the main body 10 and the compression strip 20 for a pivotal connection of the compression strip 20 to the main body 10.

Figure 4:
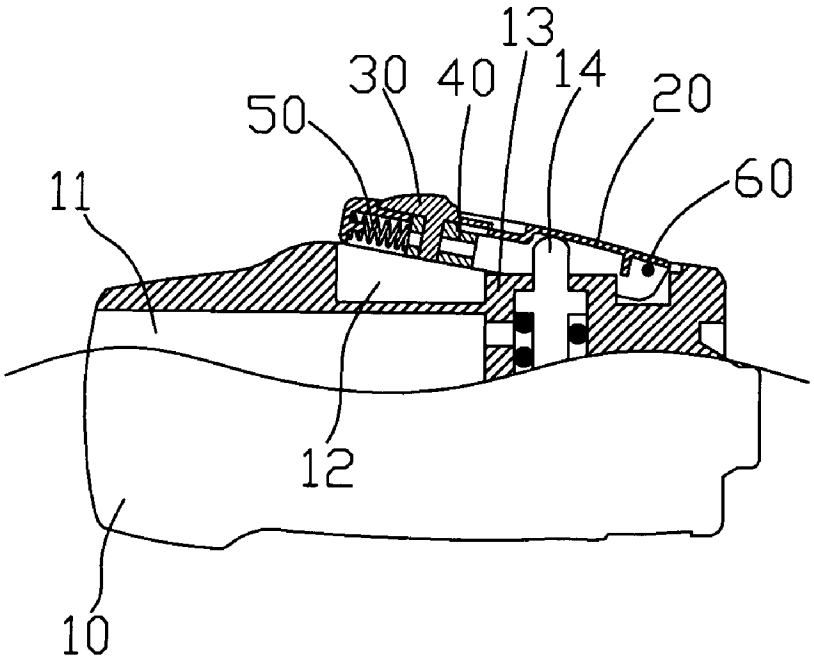
FIG. 4 is an axially cutaway view of the preferred embodiment of the invention in accordance with FIG. 1, showing the removal of a coupling element from a blocking position of a blocking portion when a push knob is shifted against the resilience of a spring.
Figure 3:
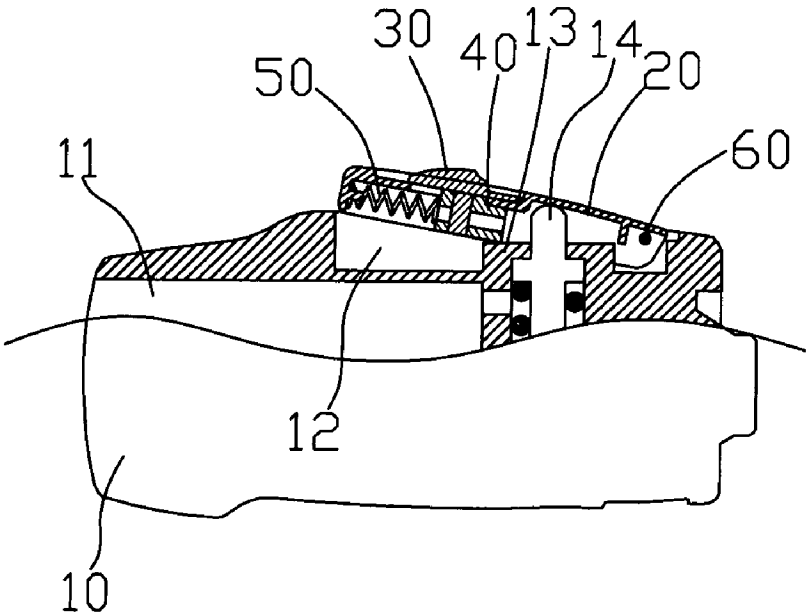
FIG. 3 is an axially cutaway view of the preferred embodiment of the invention in accordance with FIG. 1.
Figure 5:
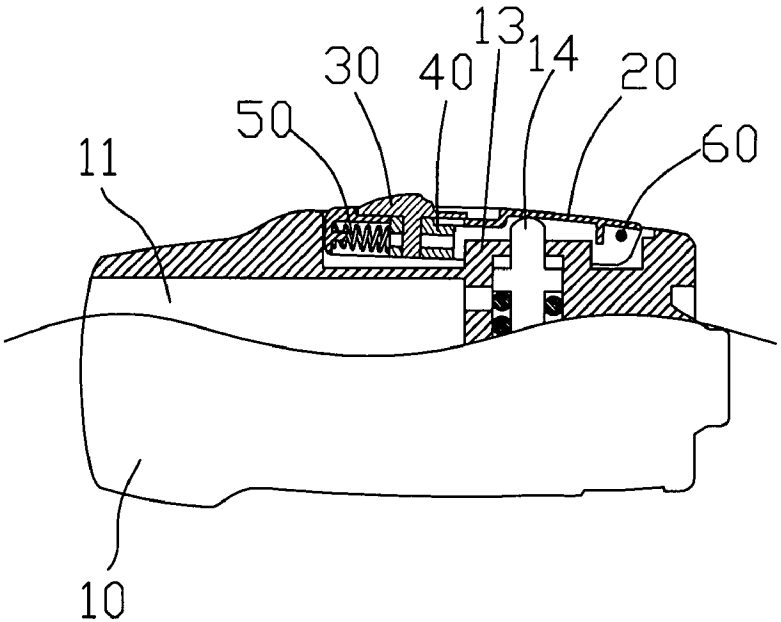
FIG. 5 is an axially cutaway view of the preferred embodiment of the invention in accordance with FIG. 1, showing that a compression strip is swiveled downwardly to move a piston in the same direction.

In the ordinary state, the compression strip 20 is not compressible due to the blocking relationship between the coupling element 40 and the blocking portion 13 of the main body 10 (see FIG. 3). As shown in FIGS. 4 and 5, the coupling element 40 is removed from the blocking position of the coupling element 40 when the push knob 30 is shifted against the resilience of the spring 50. In this way, the compression strip 20 is downwardly swiveled to move the piston 14 in the same direction.

Of course, the hollow chamber 11 of the main body 10 includes necessary air channels and other piston components that are not illustrated. These belong to the prior art so that no further descriptions are given hereinafter.

Figure 6:
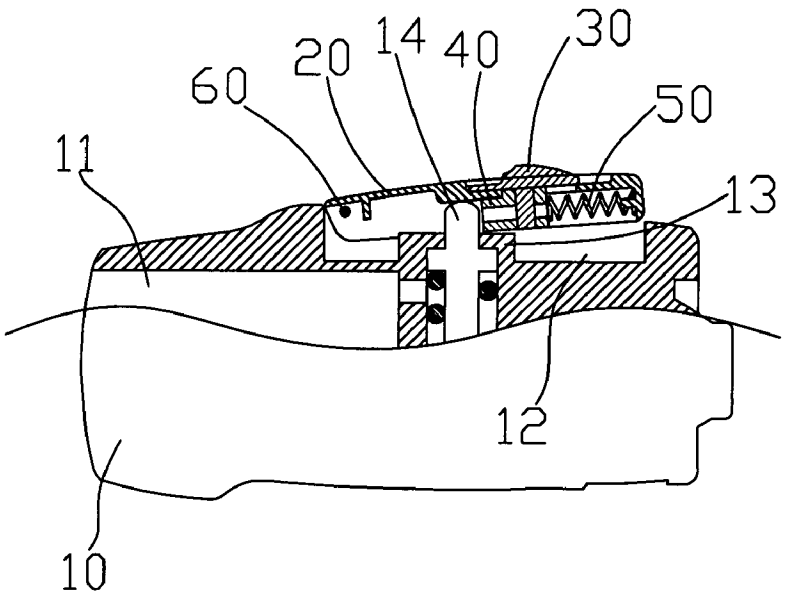
FIG. 6 is an axially cutaway view of another embodiment of the invention.

Furthermore, FIG. 6 shows another embodiment of the invention. It's apparent from FIG. 6 that the compression strip 20, the push knob 30 and the associated components are correspondingly disposed in such a position such that the right-handed (or left-handed) user can practically operate the safety switch in accordance with the invention.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. A safety start switch for a pneumatic tool comprising:

a) a main body having a hollow chamber, a recess being formed at top of the main body, a blocking portion being disposed within the recess, a piston rising above the center of the blocking portion, a pin hole being formed at top of each side of the main body;

b) a compression strip having a pin hole at one end thereof and an opening at a top side thereof, the compression strip being pivotally disposed in the recess of the main body;

c) a push knob having a stepped portion at top thereof and a protruding pin at bottom thereof;

d) a coupling element having a receiving hole into which the protruding pin of the push knob fits in a tight manner for a firm connection, the coupling element and the push knob being clamped to the top and the bottom side of the compression strip through the opening of the compression strip;

e) a spring interposed between the coupling element and the compression strip; and f) a pivot pin fitting into the aligned pin holes of the main body and the compression strip for a pivotal connection of the compression strip to the main body, whereby, in an ordinary state, the compression strip is not compressible since the coupling element rests on the blocking portion of the main body; and the compression strip is downwardly swiveled to move the piston in the same direction responsive to removal of the coupling element from the blocking position of the coupling element when the push knob is shifted against the resilience of the spring.

* * * * *